US011266257B1

(12) United States Patent
Reid

(10) Patent No.: US 11,266,257 B1
(45) Date of Patent: Mar. 8, 2022

(54) STRAW COVER

(71) Applicant: Cathy Reid, Lake City, FL (US)

(72) Inventor: Cathy Reid, Lake City, FL (US)

( * ) Notice: Subject to any disclaimer, the term of this patent is extended or adjusted under 35 U.S.C. 154(b) by 376 days.

(21) Appl. No.: 16/391,400

(22) Filed: Apr. 23, 2019

(51) Int. Cl.
*A47G 21/18* (2006.01)
*B65D 41/16* (2006.01)

(52) U.S. Cl.
CPC ..... *A47G 21/182* (2013.01); *B65D 41/16* (2013.01)

(58) Field of Classification Search
CPC .. A47G 21/18; A47G 21/182; A47G 19/2272; A47G 19/2266; B65D 41/16
USPC ..... 220/709
See application file for complete search history.

(56) References Cited

U.S. PATENT DOCUMENTS

| | | | | |
|---|---|---|---|---|
| 5,044,512 | A | 9/1991 | Giancaspro | |
| 5,048,709 | A | 9/1991 | Alverson | |
| D327,848 | S | 7/1992 | Hanover | |
| 5,201,460 | A * | 4/1993 | Caines | A47G 21/18 215/388 |
| 6,065,635 | A | 5/2000 | Sullivan | |
| 6,371,329 | B1 | 4/2002 | Wild | |
| 8,042,701 | B2 | 10/2011 | Raman | |
| D655,560 | S | 3/2012 | Stone | |
| 8,910,883 | B2 | 12/2014 | Mattheus | |
| 2008/0099494 | A1 * | 5/2008 | Boukais | B65D 47/063 220/709 |

FOREIGN PATENT DOCUMENTS

| | | |
|---|---|---|
| WO | 2010127416 | 11/2010 |

* cited by examiner

*Primary Examiner* — King M Chu

(57) ABSTRACT

The straw cover is configured for use with a straw. The straw cover encloses the straw such that the straw is protected from the environment when the straw is not in use. The straw cover comprises a base tube, a lid, a hinge, and a plurality of decorative elements. The hinge attaches the lid to the base tube such that the lid rotates from an open position to a closed position. The straw inserts through the base tube. The end of the straw is enclosed by the lid. Each of the plurality of decorative elements attaches to a structure selected from the group consisting of the base tube and the lid. The plurality of decorative elements are used to uniquely identify the straw cover.

16 Claims, 4 Drawing Sheets

STRAW COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic articles including tableware, more specifically, a closure for a drinking straw. (A47G21/18)

SUMMARY OF INVENTION

The straw cover is configured for use with a straw. A straw is a tubular structure used to draw a liquid from a container using a vacuum. The straw is further defined with a first outer dimension. The straw cover encloses the straw such that the straw is protected from the environment when the straw is not in use. The straw cover comprises a base tube, a lid, a hinge, and a plurality of decorative elements. The hinge attaches the lid to the base tube such that the lid rotates from an open position to a closed position. The straw inserts through the base tube. The end of the straw is enclosed by the lid. Each of the plurality of decorative elements attaches to a structure selected from the group consisting of the base tube and the lid. The plurality of decorative elements are used to uniquely identify the straw cover.

These together with additional objects, features and advantages of the straw cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the straw cover in detail, it is to be understood that the straw cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the straw cover.

It is therefore important that the claims be regarded as including such equivalent construction insofar as they do not depart from the spirit and scope of the straw cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
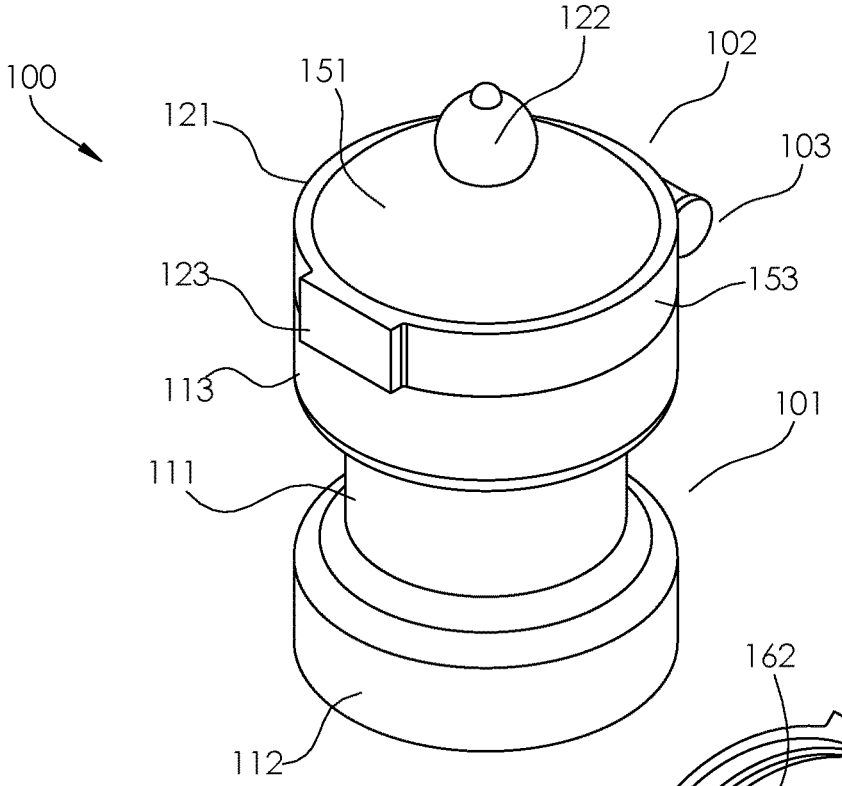
FIG. 1 is a perspective view of an embodiment of the disclosure.
Figure 2:
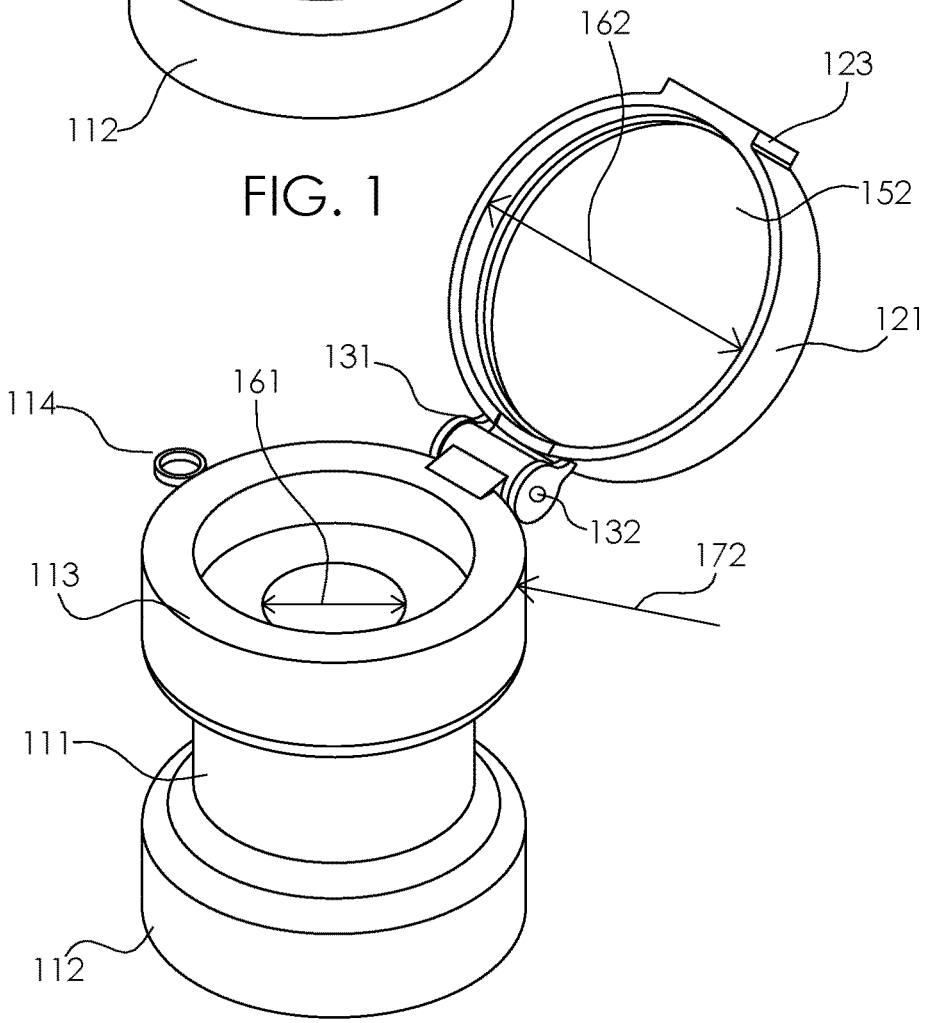
FIG. 2 is a perspective view of an embodiment of the disclosure.
Figure 3:
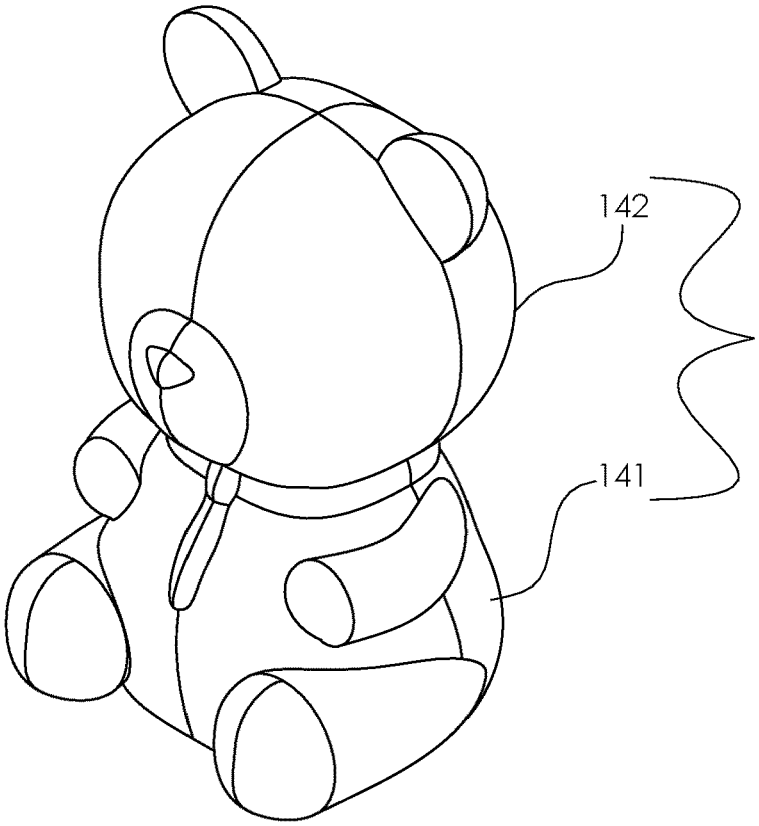
FIG. 3 is a perspective view of an alternate embodiment of the disclosure.
Figure 4:
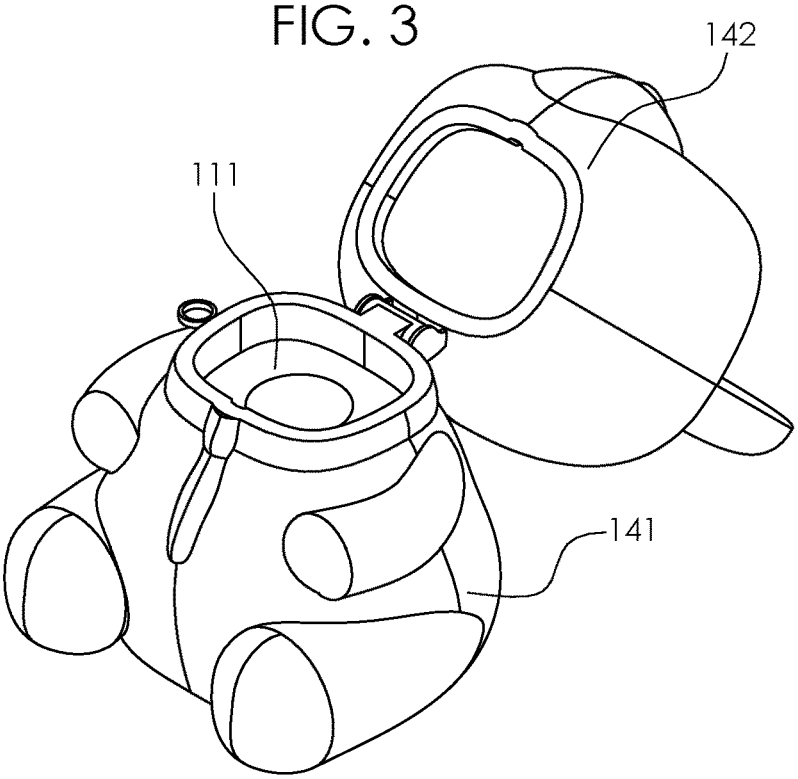
FIG. 4 is a perspective view of an alternate embodiment of the disclosure.
Figure 5:
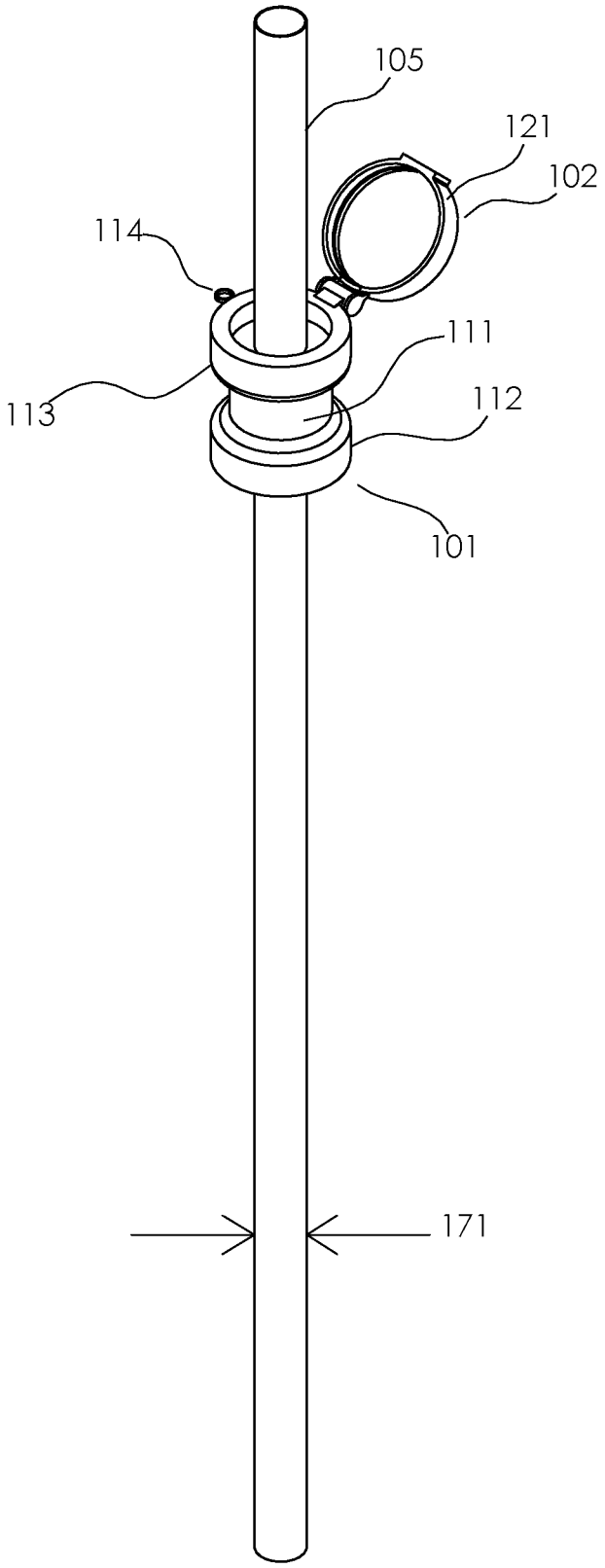
FIG. 5 is an in-use view of an embodiment of the disclosure.
Figure 6:
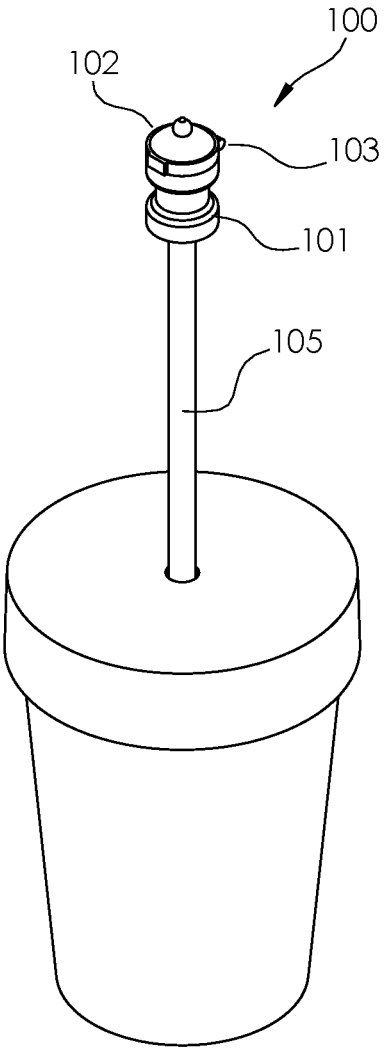
FIG. 6 is an in-use view of an embodiment of the disclosure.
Figure 7:
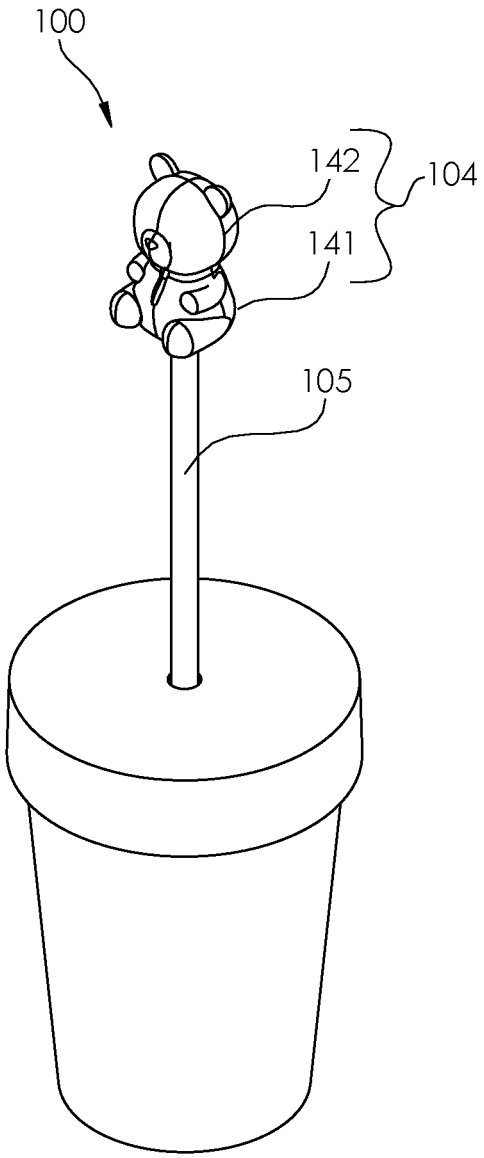
FIG. 7 is an in-use view of an alternate embodiment of the disclosure.

Detailed reference will now be made to one or more potential embodiments of the disclosure, which are illustrated in FIGS. 1 through 7.

The straw cover 100 (hereinafter invention) is configured for use with a straw 105. A straw 105 is a tubular structure used to draw a liquid from a container using a vacuum. The straw 105 is further defined with a first outer dimension 171. The invention 100 encloses the straw 105 such that the straw 105 is protected from the environment when the straw 105 is not in use. The straw 105 is a well-known and documented device commonly used with liquid foodstuffs.

The invention 100 comprises a base tube 101, a lid 102, a hinge 103, and a plurality of decorative elements 104. The hinge 103 attaches the lid 102 to the base tube 101 such that the lid 102 rotates from an open position to a closed position. The straw 105 inserts through the base tube 101. The end of the straw 105 is enclosed by the lid 102. Each of the plurality of decorative elements 104 attaches to a structure selected from the group consisting of the base tube 101 and the lid 102. The plurality of decorative elements 104 are used to uniquely identify the invention 100.

The base tube 101 is a composite prism structure. The base tube 101 has a tubular structure. The straw 105 inserts through the base tube 101. The base tube 101 comprises a master tube 111, an inferior disk 112, and a superior disk 113. The inferior disk 112 attaches to the master tube 111 to form a composite prism structure. The superior disk 113 attaches to the master tube 111 to form a composite prism structure. The master tube 111 is further defined with a first inner dimension 161. The superior disk 113 is further defined with a second outer dimension 172.

The master tube 111 is a hollow prism-shaped structure. The negative space that forms the aperture through the master tube 111 is geometrically similar to the prism shape of the straw 105. The first outer dimension 171 of the straw 105 is lesser than the first inner dimension 161 of the negative space that forms the aperture through the master tube 111 such that the straw 105 inserts through the master tube 111.

The inferior disk 112 is a hollow prism-shaped structure. The inferior disk 112 has a ring-shape. The inferior disk 112 is geometrically similar to the prism shape of the master tube 111. The inferior disk 112 is sized such that the master tube 111 will insert into the inferior disk 112 to form a fluid impermeable seal that attaches the inferior disk 112 to the master tube 111. The straw 105 passes through the aperture formed in the inferior disk 112 to insert into the master tube 111.

The superior disk 113 is a hollow prism-shaped structure. The superior disk 113 has a ring-shape. The superior disk 113 is geometrically similar to the prism shape of the master tube 111. The superior disk 113 is sized such that the master tube 111 will insert into the superior disk 113 to form a fluid impermeable seal that attaches the superior disk 113 to the master tube 111. The straw 105 passes into the superior disk 113 from the master tube 111. The position of the superior disk 113 is distal from the inferior disk 112.

The superior disk 113 further comprises a ring 114. The ring 114 is a loop-shaped structure. The ring 114 attaches to the lateral surface of the disk structure of the superior disk 113. The ring 114 forms an anchor point that allows accessories to attach to the invention 100.

The lid 102 is a capped tube. The lid 102 encloses the straw 105 that inserts into the base tube 101. The lid 102 comprises a pan 121, a bead 122, and a thumb plate 123. The bead 122 attaches to the pan 121. The thumb plate 123 attaches to the pan 121. The pan 121 is further defined with a second inner dimension 162.

The pan 121 is a capped tube. The pan 121 has a pan 121 shape. The pan 121 is geometrically similar to the prism shape of the superior disk 113. The pan 121 forms the structure that encloses the negative space formed by the ring-shaped structure of the superior disk 113. The pan 121 rotates relative to the superior disk 113 between an open position and a closed position.

The pan 121 comprises a closed face 151, an open face 152, and a lateral face 153. The closed face 151 refers to the enclosed congruent end of the pan 121. The open face 152 refers to the open congruent end of the pan 121. The open face 152 is distal from the closed face 151. The lateral face 153 is the lateral face of the disk structure that forms the pan 121.

The second inner dimension 162 of the open face 152 of the pan 121 is greater than the second outer dimension 172 of the superior disk 113 such that the open face 152 of the pan 121 fits over the superior disk 113 when the pan 121 is in the closed position. The closed position of the pan 121 encloses the straw 105 within the negative space of the superior disk 113.

The bead 122 is a projection formed on the exterior surface of the closed face 151 of the pan 121. The bead 122 forms a grip structure that forms a lever used to rotate the lid 102 from the closed position to the open position. The thumb plate 123 is a rectangular disk structure formed on the lateral face 153 of the pan 121. The thumb plate 123 forms a grip structure that forms a lever used to rotate the lid 102 from the closed position to the open position.

The hinge 103 is a fastening structure. The hinge 103 attaches the lid 102 to the base tube 101 such that the lid 102 rotates between an open position and a closed position relative to the base tube 101. The hinge 103 comprises a hinge 103 mount 131 and a pivot 132.

The hinge 103 mount 131 is a mechanical structure that is permanently attached in the lateral surface of the superior disk 113. The hinge 103 mount 131 receives the pivot 132 such that the pivot 132 rotates freely within the hinge 103 mount 131. The pivot 132 is a cylindrical shaft structure. The pivot 132 is a rotating structure. The pivot 132 attaches the lid 102 to the superior disk 113 of the base tube 101 such that the lid 102 rotates relative to the base tube 101. The use of a pivot 132 for this purpose is well-known and documented in the mechanical arts.

The invention 100 further comprises a plurality of decorative elements 104 Each of the plurality of decorative elements 104 uniquely identifies a specific instantiation of the invention 100 such that beverages may be readily associated with the individual consuming the beverage. The plurality of decorative elements 104 comprises a base decorative element 141 and a lid decorative element 142.

The base decorative element 141 is a decorative structure that attaches to the exterior surfaces of the inferior disk 112 and the superior disk 113 of the base tube 101. The base decorative element 141 is used to uniquely identify the instantiation of the invention 100 associated with the base decorative element 141. The lid decorative element 142 is a decorative structure that attaches to the exterior surfaces of the pan 121 of the lid 102. The lid decorative element 142 is used to uniquely identify the instantiation of the invention 100 associated with the lid decorative element 142.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned.

When the center axes of two cylinder, prism or pyramidal structures do not share the same line they are said to be offset.

Closed Position: As used in this disclosure, a closed position refers to a movable barrier structure that is in an orientation that prevents passage through a port or an aperture. The closed position is often referred to as an object being "closed."

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter. Include Radial Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object. A hinge designed to be fixed into a set position after rotation is called a locking hinge.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Lid: As used in this disclosure, a lid is a removable cover that is placed over an opening of a hollow structure to enclose the hollow structure.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) an end of the prism structure that forms the pan; and, b) a lateral face of the prism structure that forms the pan.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Ring: As used in this disclosure, a ring is a term that is used to describe a disk-like structure through which an aperture is formed. Rings are often considered loops.

Shaft: As used in this disclosure, a shaft is a long, narrow and rigid prism structure that is used as: 1) a structural element of a larger object; or 2) as a grip or lever for a handle. Shafts often have a cylindrical shape.

Superior: As used in this disclosure, the term superior refers to a directional reference that is parallel to and in the opposite direction of the force of gravity when an object is positioned or used normally.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vacuum: As used in this disclosure, vacuum is used to describe a first space that contains gas at a reduced gas pressure relative to the gas pressure of a second space. If the first space and the second space are connected together, this pressure differential will cause gas from the second space to move towards the first space until the pressure differential is eliminated.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A drinking-straw cover comprising:

a base tube, a lid, and a hinge;

wherein the hinge attaches the lid to the base tube such that the lid rotates from an open position to a closed position;

wherein the drinking-straw cover is configured for use with a straw;

wherein the straw is further defined with a first outer dimension;

wherein the straw inserts through the base tube;

wherein the drinking-straw cover encloses the straw;

wherein the base tube has a tubular structure;

wherein the lid is a capped tube;

wherein the lid encloses the straw that inserts into the base tube;

wherein the hinge is a fastening structure;

wherein the hinge attaches the lid to the base tube such that the lid rotates between an open position and a closed position relative to the base tube;

wherein the base tube comprises a master tube, an inferior disk, and a superior disk;

wherein the inferior disk attaches to the master tube;

wherein the superior disk attaches to the master tube;

wherein the master tube is further defined with a first inner dimension;

wherein the superior disk is further defined with a second outer dimension;

wherein the lid comprises a pan, a bead, and a thumb plate;

wherein the bead attaches to the pan;

wherein the thumb plate attaches to the pan;

wherein the pan is further defined with a second inner dimension.

2. The drinking-straw cover according to claim 1 wherein the master tube is a hollow prism-shaped structure;

wherein the negative space that forms the aperture through the master tube is geometrically similar to the prism shape of the straw;

wherein the first outer dimension of the straw is lesser than the first inner dimension of the negative space that forms the aperture through the master tube such that the straw inserts through the master tube.

3. The drinking-straw cover according to claim 2 wherein the inferior disk is a hollow prism-shaped structure;

wherein the inferior disk has a ring-shape;

wherein the inferior disk is geometrically similar to the prism shape of the master tube;

wherein the inferior disk is sized such that the master tube will insert into the inferior disk to form a fluid impermeable seal that attaches the inferior disk to the master tube;

wherein the straw passes through the aperture formed in the inferior disk to insert into the master tube.

4. The drinking-straw cover according to claim 3
wherein the superior disk is a hollow prism-shaped structure;
wherein the superior disk has a ring-shape;
wherein the superior disk is geometrically similar to the prism shape of the master tube;
wherein the superior disk is sized such that the master tube will insert into the superior disk to form a fluid impermeable seal that attaches the superior disk to the master tube;
wherein the straw passes into the superior disk from the master tube;
wherein the position of the superior disk is distal from the inferior disk.

5. The drinking-straw cover according to claim 4
wherein the superior disk further comprises a ring;
wherein the ring is a loop-shaped structure;
wherein the ring attaches to the lateral surface of the disk structure of the superior disk;
wherein the ring forms an anchor point that allows accessories to attach to the drinking-straw cover.

6. The drinking-straw cover according to claim 5
wherein the pan is a capped tube;
wherein the pan has a pan shape;
wherein the pan is geometrically similar to the prism shape of the superior disk;
wherein the pan forms the structure that encloses the negative space formed by the ring-shaped structure of the superior disk;
wherein the pan rotates relative to the superior disk between an open position and a closed position;
wherein the pan comprises a closed face, an open face, and a lateral face;
wherein the closed face refers to the enclosed congruent end of the pan;
wherein the open face refers to the open congruent end of the pan;
wherein the open face is distal from the closed face;
wherein the lateral face is the lateral face of the disk structure that forms the pan;
wherein the second inner dimension of the open face of the pan is greater than the second outer dimension of the superior disk such that the open face of the pan fits over the superior disk when the pan is in the closed position.

7. The drinking-straw cover according to claim 6
wherein the bead is a projection formed on the exterior surface of the closed face of the pan;
wherein the bead forms a grip structure that forms a lever used to rotate the lid from the closed position to the open position;
wherein the thumb plate is a rectangular disk structure formed on the lateral face of the pan;
wherein the thumb plate forms a grip structure that forms a lever used to rotate the lid from the closed position to the open position.

8. The drinking-straw cover according to claim 7
wherein the hinge comprises a hinge mount and a pivot;
wherein the hinge mount is a mechanical structure that is permanently attached in the lateral surface of the superior disk;
wherein the hinge mount receives the pivot such that the pivot rotates freely within the hinge mount;
wherein the pivot is a cylindrical shaft structure;
wherein the pivot is a rotating structure;
wherein the pivot attaches the lid to the superior disk of the base tube such that the lid rotates relative to the base tube.

9. The drinking-straw cover according to claim 1
wherein the drinking-straw cover further comprises a plurality of decorative elements;
wherein each of the plurality of decorative elements attaches to a structure selected from the group consisting of the base tube and the lid.

10. The drinking-straw cover according to claim 9
wherein the master tube is a hollow prism-shaped structure;
wherein the negative space that forms the aperture through the master tube is geometrically similar to the prism shape of the straw;
wherein the first outer dimension of the straw is lesser than the first inner dimension of the negative space that forms the aperture through the master tube such that the straw inserts through the master tube.

11. The drinking-straw cover according to claim 10
wherein the inferior disk is a hollow prism-shaped structure;
wherein the inferior disk has a ring-shape;
wherein the inferior disk is geometrically similar to the prism shape of the master tube;
wherein the inferior disk is sized such that the master tube will insert into the inferior disk to form a fluid impermeable seal that attaches the inferior disk to the master tube;
wherein the straw passes through the aperture formed in the inferior disk to insert into the master tube.

12. The drinking-straw cover according to claim 11
wherein the superior disk is a hollow prism-shaped structure;
wherein the superior disk has a ring-shape;
wherein the superior disk is geometrically similar to the prism shape of the master tube;
wherein the superior disk is sized such that the master tube will insert into the superior disk to form a fluid impermeable seal that attaches the superior disk to the master tube;
wherein the straw passes into the superior disk from the master tube;
wherein the position of the superior disk is distal from the inferior disk;
wherein the superior disk further comprises a ring;
wherein the ring is a loop-shaped structure;
wherein the ring attaches to the lateral surface of the disk structure of the superior disk;
wherein the ring forms an anchor point that allows accessories to attach to the drinking-straw cover.

13. The drinking-straw cover according to claim 12
wherein the pan is a capped tube;
wherein the pan has a pan shape;
wherein the pan is geometrically similar to the prism shape of the superior disk;
wherein the pan forms the structure that encloses the negative space formed by the ring-shaped structure of the superior disk;
wherein the pan rotates relative to the superior disk between an open position and a closed position;
wherein the pan comprises a closed face, an open face, and a lateral face;
wherein the closed face refers to the enclosed congruent end of the pan;

wherein the open face refers to the open congruent end of the pan;

wherein the open face is distal from the closed face;

wherein the lateral face is the lateral face of the disk structure that forms the pan;

wherein the second inner dimension of the open face of the pan is greater than the second outer dimension of the superior disk such that the open face of the pan fits over the superior disk when the pan is in the closed position.

14. The drinking-straw cover according to claim 13 wherein the bead is a projection formed on the exterior surface of the closed face of the pan;

wherein the bead forms a grip structure that forms a lever used to rotate the lid from the closed position to the open position;

wherein the thumb plate is a rectangular disk structure formed on the lateral face of the pan;

wherein the thumb plate forms a grip structure that forms a lever used to rotate the lid from the closed position to the open position.

15. The drinking-straw cover according to claim 14 wherein the hinge comprises a hinge mount and a pivot;

wherein the hinge mount is a mechanical structure that is permanently attached in the lateral surface of the superior disk;

wherein the hinge mount receives the pivot such that the pivot rotates freely within the hinge mount;

wherein the pivot is a cylindrical shaft structure;

wherein the pivot is a rotating structure;

wherein the pivot attaches the lid to the superior disk of the base tube such that the lid rotates relative to the base tube.

16. The drinking-straw cover according to claim 15 wherein the plurality of decorative elements comprises a base decorative element and a lid decorative element;

wherein the base decorative element is a decorative structure that attaches to the exterior surfaces of the inferior disk and the superior disk of the base tube;

wherein the base decorative element is used to uniquely identify the instantiation of the drinking-straw cover associated with the base decorative element;

wherein the lid decorative element is a decorative structure that attaches to the exterior surfaces of the pan of the lid.

* * * * *